United States Patent [19]

Akiyama

[11] Patent Number: 4,740,285

[45] Date of Patent: Apr. 26, 1988

[54] PLATING HOOKING APPARATUS

[75] Inventor: Masaaki Akiyama, Sunto, Japan

[73] Assignee: Usui Kokusai Sangyo Kabushiki Kaisha, Nagasawa, Japan

[21] Appl. No.: 96,610

[22] Filed: Sep. 11, 1987

[51] Int. Cl.[4] ..... C25D 17/06

[52] U.S. Cl. ..... 204/202

[58] Field of Search ..... 204/198, 202

[56] References Cited

U.S. PATENT DOCUMENTS 3,616,424 10/1971 Barton ..... 204/202

*Primary Examiner*—T. M. Tufariello

*Attorney, Agent, or Firm*—Anthony J. Casella; Gerald E. Hespos

[57] ABSTRACT

A plating hooking apparatus incorporated into an automatic conveyer permits plate-objects to rotate in and above a plating tank. This apparatus has a current conduction bar extending over the plating tank, hung-down rods suspended from the current conduction bar, hooking jigs rotatably secured to the lower ends of the hung-down rods, a driven rod engaging with a driving unit to move laterally and drive transmission means for rotating the hooking jigs by propagating the lateral movement of the driven rod to the hooking jigs. The drive transmission means includes a rack, a pinion, first means for converting a rotation of the pinion into a rectilinear motion, second means for converting the rectilinear motion into a rotary motion and means for propagating the rotary motion to the hooking jigs. With this arrangement, the hooking jigs are capable of rotating in and above the plating tank.

6 Claims, 5 Drawing Sheets

PRIOR ART

PLATING HOOKING APPARATUS

BACKGROUND OF THE INVENTION

1. Field of the Invention

The present invention generally relates to a hooking apparatus for electric plating, and more particularly, to a plating hooking apparatus incorporated in an automatic conveyer so that objects to be plated are rotated in and above a plating tank.

2. Description of the Prior Art

As illustrated in FIG. 1, a conventional hooking apparatus has been arranged such that hooks 32 serving to charge the objects to be plated with electricity while hanging the objects thereon are protrudently provided on support branches 33 assembled into a frame assuming a desired configuration, and the support branches 33 secured to a support pole 34 is suspended from a current conduction bar 31.

In such a hooking apparatus, however, plating is effected on the hooked objects under the condition that the objects are disposed invariably in the same position and in the same direction within the plating tank. Consequently, there arise many problems in which the plating is apt to be uneven in thickness, unplated portions are created in the products each assuming an intricate configuration becuase of inside stagnant air, i.e., an air pocket, and a large quantity of processing liquid is taken outside when pulling up the plated objects from the plating tank, this bringing about futility of the liquid.

SUMMARY OF THE INVENTION

It is a primary object of the present invention which obviates the above-described problems to provide a hooking apparatus arranged such that the hooking apparatus is formed with a frame and is automatically rotated in a vertical plane in and above a plating tank, thereby enhancing the quality in plating and eliminating a trouble pertaining to the take-out of the plating liquid.

To this end, according to one aspect of the invention, there is provided a hooking apparatus arranged such that: hooking jigs which are axially rotatably secured at their center to lower ends of hung-down rods suspended from a current conduction bar attached to an upper portion of the plating tank, this current conduction bar being transferred by a conveyer; a driven rod disposed in parallel with the current conduction bar is laterally movable, this lateral movement of the driven rod being made by engagement with a driving device; and drive transmission means is provided so that the hooking jigs are rotated in a vertical plane by dint of the lateral movement of the driven rod.

With this arrangement, each of the plating hooking jigs is capable of automatically rotating in the vertical plane in and above the plating tank with the result that the plating is uniformly effected, especially non-plating caused by an air pocket can be eliminated, and undesirable accumulation of liquid between the plated objects can be avioded, thereby minimizing an amount of liquid taken out of the plating tank.

ngs:

BRIEF DESCRIPTION OF THE DRAWINGS

These and other objects, features and advantages of the present invention will be seen by reference to the the following description, taken in connection with the accompanying drawings, in which.

DETAILED DESCRIPTION OF THE PREFERRED EMBODIMENTS

One embodiment of the present invention will hereinafter be described with reference to the accompanying drawings.

Figure 1:
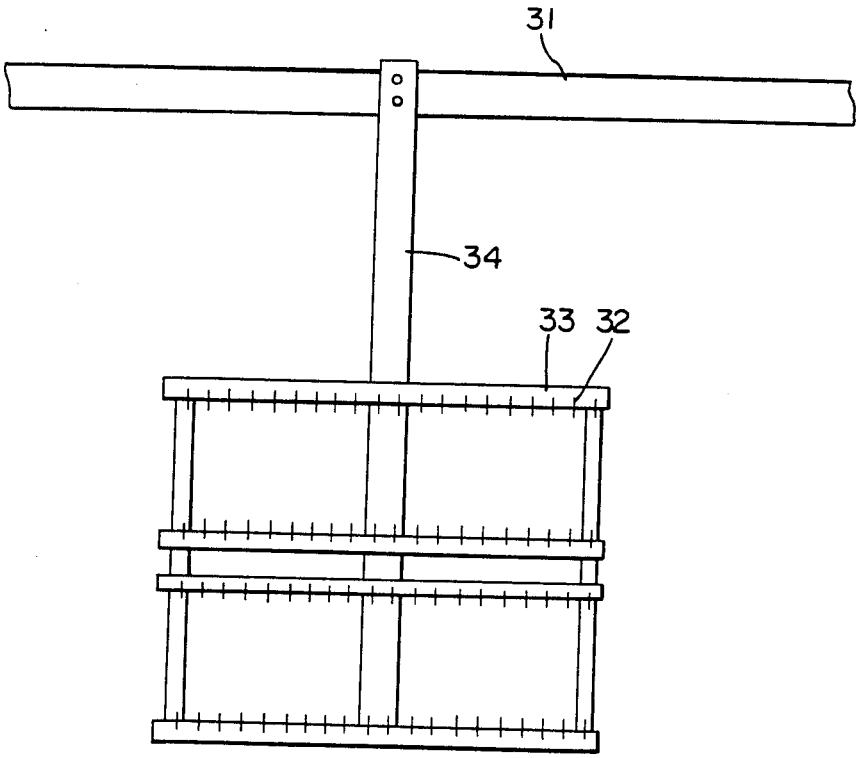
FIG. 1 is a front view showing a conventional plating hooking apparatus.
Figure 2:
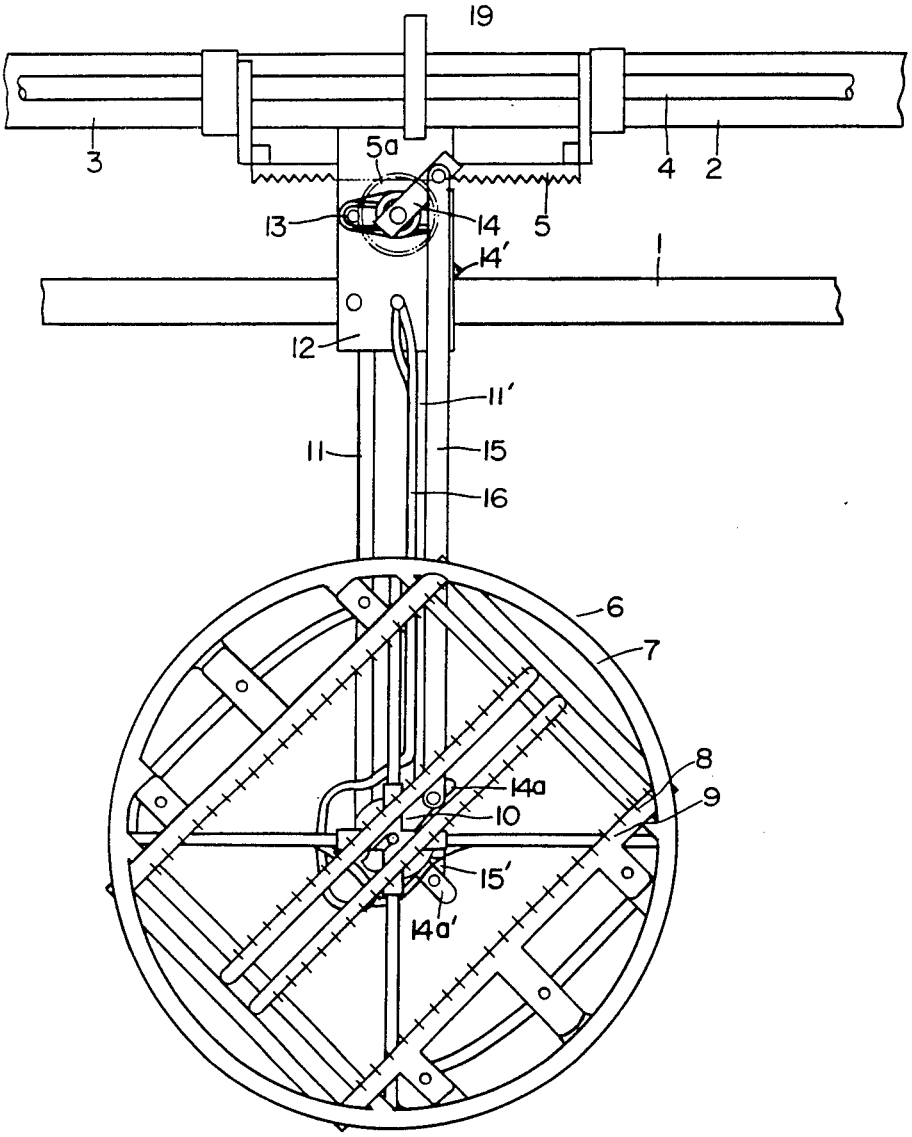
FIG. 2 is a front view showing one embodiment of a plating hooking apparatus according to the present invention.

In FIG. 2, the reference numeral 1 represents a current conduction bar composed of a copper bar. This current conduction bar is transferred by a conveyer to extend over a plating tank. At this time, both ends of the current conduction bar are brought into contact with electrodes, whereby the bar 1 is charged with the electricity. The numeral 2 denotes a support bar, disposed in parallel with the current conduction bar 1, for supporting and reinforcing the current conduction bar 1. The support bar is transferred, and bearings 3 (see FIG. 3) provided at both ends of the support bar 2 are suspended by suspension supporting members of the conveyer. A driven rod indicated generally at 4 is movable along the support bar 2 in the lateral direction within a given range. The driven rod 4 is driven by engaging with a separately provided driving device. The driven rod is provided with a rack 5 placed in a suitable position thereof. The current conduction bar 1, the support bar 2 and the driven rod 4 are assembled each other to form a transverse framed body whose size corresponds to a length of the plating tank. The transverse framed body is moved together with hooking jigs 6 suspended therefrom. The hooking jigs 6 will next be explained.

Such is the arrangement of the hooking jig that current conduction rods 9 protrudently provided with a multiplicity of hooks 8 are fitted to appropriate portions along the inner periphery of a circular reinforced support frame 7. A pair of hooking jigs 6 are assembled back-to-back to reinforce each other. Central portions 10 of the pair of hooking jigs 6 are axially rotatably secured to lower ends of a pair of hung-down rods 11 and 11' fixed to the current conduction bar 1. The hooking jigs 6 are thus suspended. A pair of attaching plates indicated generally at 12 are fixed to the current conduction bar 1 together with the hung-down rods 11 and 11'. A pinion **5*a* engaging with the rack 5 is axially supported on an adaptor 13 on the inside common to the attaching plates 12. A pair of levers 14 and 14' which are connected at a substantially right angle to a shaft of the pinion 5*a*. A pair of levers 14*a* and 14*a'* are provided at the central portions 10 of the hooking jigs 6. The two pairs of ° ) levers, 14, 14', 14*a*, and 14*a'* are connected through pins to each other. A pair of lead wires indicated generally at 16 permit the electricity to flow from the current conduction bar 1 to current conduction rods 9**.

Figure 3:
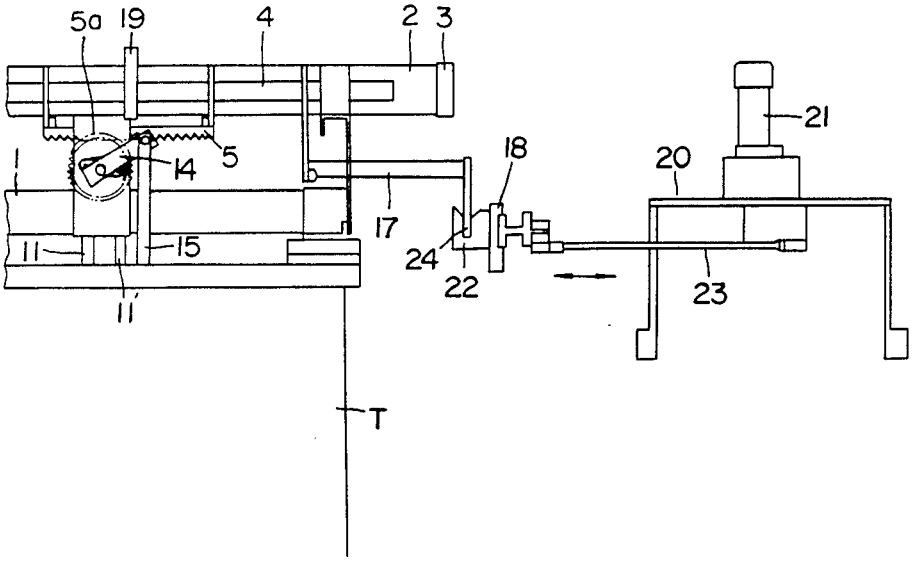
FIG. 3 is a front view illustrating a state in which a plating hooking jig is engaged with a driving device for rotating the plating hooking jig in a plating tank.

When the hooking jigs 6 (see FIG. 2) are soaked in a plating bath, a driving device 20 is, as depicted in FIG. 3, disposed beside a plating tank T. This driving device 20 consists of a motor 21 and a bracket 22 formed with an engagement groove 24, this bracket 22 moving in the lateral direction indicated by an arrowhead by means of a crank mechanism 23 connected to the motor 21.

Figure 4:
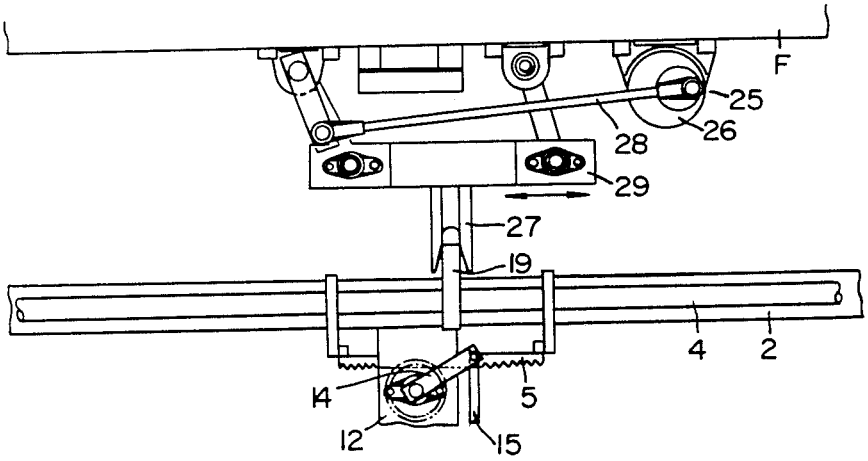
FIG. 4 is a front view illustrating a state in which the plating hooking jig is engaged with the driving device for rotating the plating hooking jig above the plating tank.

As shown in FIG. 4, a driving device 25 suspended from a mount F of the conveyer is composed of a motor 26, a moving plate 29 which moves in the lateral direction indicated by an arrowhead by means of a crank mechanism 28 linked to the motor 26 and a sandwiching members 27 each projecting from the moving plate 29. When the hooking jigs 6 are pulled up by the conveyer from the plating bath while being suspended from the current conduction bar 1, a projecting member 19 which is protrudently provided at the intermediate portion of the driven rod 4 is arranged to be interposed in between the sandwiching members 27.

The operation of the thus constructed apparatus will be described as follows.

When the hooking jigs on which the objects to be plated are hung are transferred by the conveyer while being suspended from the current conduction bar 1 and are then soaked in the plating bath, as illustrated in FIG. 3, an engagement plate 18 connectively provided at the driven rod 4 engages with the bracket 22 of the driving device 20. The driven rod 4 repeatedly makes its lateral movements within the specified scope by dint of the actuation of the driving device 20. The rack 5 meshes with the pinion **5*a* provided on the attaching plate 12 fixed to the current conduction bar 1, whereby the levers 14 and 14' are turned. The hooking jigs 6 repeatedly rotate through 180° with respect to the vertical plane through the intermediary of connecting rods 15, 15' and the levers 14*a* and 14*a'*** within the plating tank T. For this reason, the objects can be plated within the plating tank T in such a way that the vertical position and the direction are continuously varied.

Next, after the plating has been completed, the hooking jigs 6 are raised up to the upper portion of the plating tank T. At this time, the projecting member 19 jutting out from the driven rod 4 is, as illustrated in FIG. 4, intruded in between the sandwiching members 27 of the driving device 25. Upon the actuation of the driving device 25, the driven rod 4 laterally moves in the same manner as described above. Then the hooking jigs 6 rotate throguh 180° in the air, which ensures that the liquid stuck to the plated objects is dropped down into the plating tank T, thereby producing no accumulation of the liquid between these plated objects.

Figure 5:
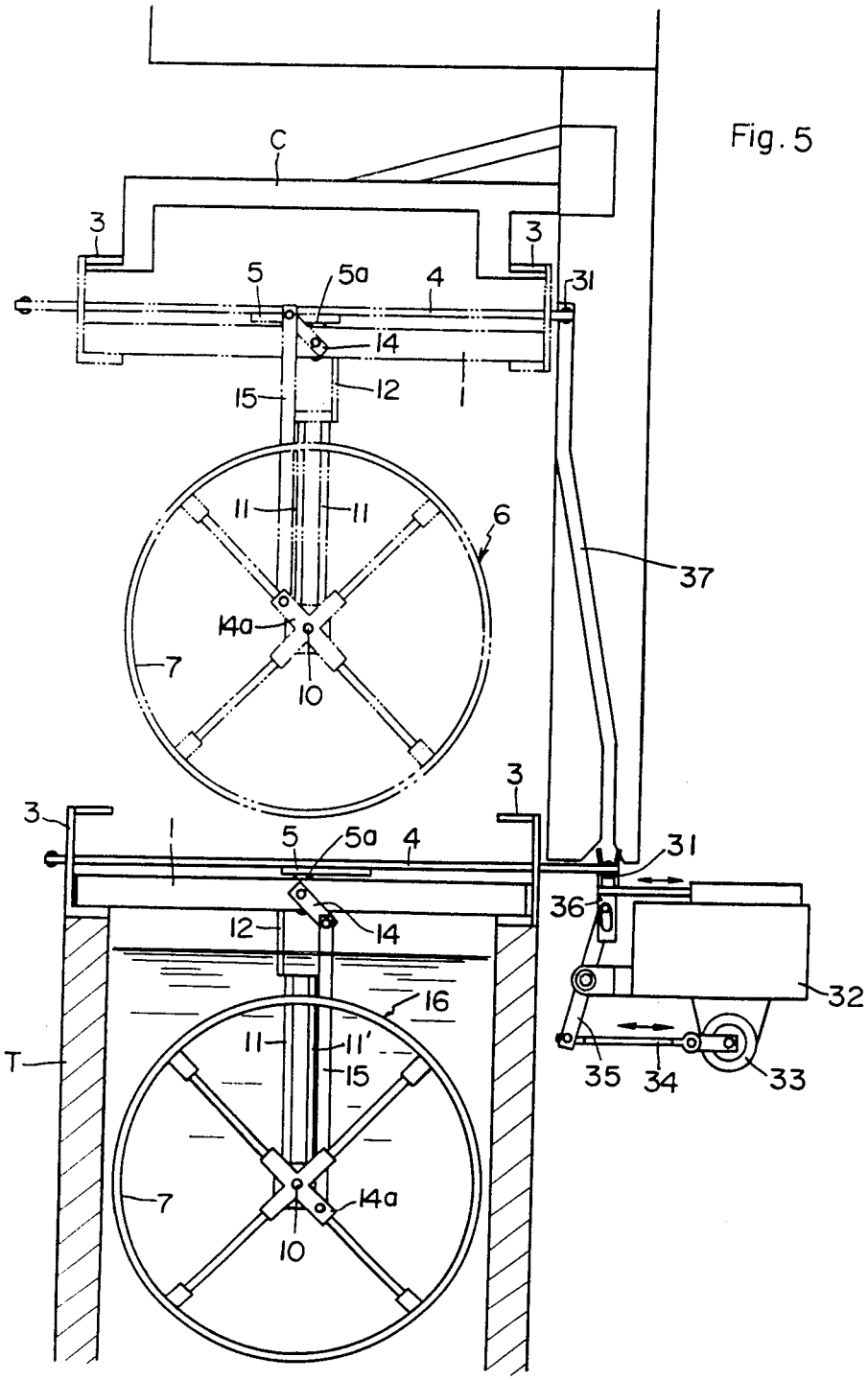
FIGS. 5 and 6 are front views showing other embodiments of the plating hooking apparatus acording to the present invention.

FIG. 5 is a front view illustrating another embodiment of the plating hooking apparatus relative to the present invention. The solid line depicts a state in which the hooking jig is in the plating bath, whereas the one-dotted line depicts a state in which the hooking jig is pulled up therefrom. In the Figure, the current conduction bar 1 is transferred by a conveyer C and then spans the plating tank T. At this time, both end thereof are brought into contact with the electrodes, whereby the current conduction bar 1 is charged with the electricity. In this case, the current conduction bar 1 is transferred in such a manner that bearings 3 provided at both ends thereof are suspended from suspension support members 30 of the conveyer C. The driven rod 4 is retained between the bearings 3 so that the driven rod 4 is movable in the lateral direction along the current conduction bar 1 within the specified range. One end of the driven rod 4 is provided with a guide pin 31. The rack 5 is provided in an adequate position of the driven rod 4. The current conduction bar 1, the bearings 3 and the driven rod are assembled each other to constitute a transverse framed body the size of which corresponds to a length of the plating tank T. The transverse framed body is transferred by the conveyer C together with the hooking jigs suspended therefrom, the jigs being shown in FIG. 2. It is to be noted that the hooking jigs are partially omitted, however, the constitution is almost the same as that of FIG. 2. The description is therefore omitted herein. When the hooking jigs are immersed in the plating bath, a driving device 32 provided beside the plating tank T reciprocates in the directions pointed by the arrowheads with the help of a motor 33 and a crank mechanism 34 linked to the motor 33. Then a receiving member 36 laterally reciprocates through the intermediary of a lever 35. The receiving member 36 is slidably held by the driving device 32 and serves to receive the guide pin 31 secured to the end portion of the driven rod 4.

Immediately when the hooking jigs are raised straight by the conveyer C from the plating bath while being suspended from the current conduction bar 1, the guide pin 31 provided on the driven rod 4 ascends along a guide groove 37 formed just above this guide pin 31. The guide groove 37 is so arranged to deviate laterally with closer proximity to the upper portion.

Hence, when the driven rod 4 laterally deviates from the current conduction bar 1, the rack 5 meshes with the pinion **5*a*, thereby rotating the pinon 5*a*. Then the hooking jigs are rotated through 180° with the aid of the connecting rod 15 and levers 14 and 14*a*. In order to obtain smooth rotation of the hooking jigs 6, as in the case of FIG. 2, the unillustrated corresponding levers 14' and 14*a'* and connecting rod 15'** are provided.

The operation will next be described.

The hooking jigs on which the objects are hung are transferred by the conveyer C while being suspended from the current conduction bar 1 and are then immersed in the plating bath. At this time. the guide pin 31 secured to the driven rod 4 engages with the receiving member of the driving device 32, whereby the driven rod 4 repeats its lateral reciprocating motion within the specified range. Inevitably, the rack 5 fitted to the driven rod 4 moves laterally and then meshes with the pinion **5*a* attached to the current conduction bar 1, thereby rotating the lever 14. The hooking jigs repeatedly rotate through 180° with respect to the vertical plane with the aid of the connecting rod 15 and the lever 14*a* in the plating tank T. In this case, the objects are plated in such a way that there are continuous variations in the vertical position and direction of objects. This situation is the same as that of FIG. 2**.

After the plating has been finished, the hooking jigs are raised up to the upper portion of the plating tank T. Subsequently, the guide pin 31 provided on the driven rod 4 moves in the lateral direction along the guide groove 37, and hence the driven rod 4 deviates from the current conduction bar 1. Then the hooking jigs rotate through 180° in the air. With this arrangement, it is feasible to eliminate the accumulation of the liquid, because the liquid stuck to the plated objects is dropped down into the plating tank T.

Figure 6:
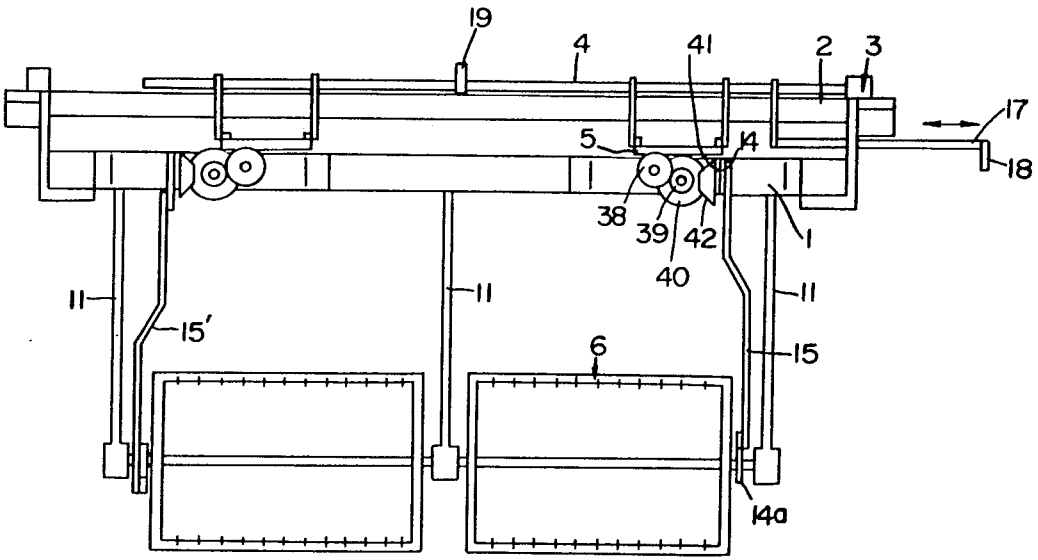

FIG. 6 is a front view illustrating still another embodiment of the present invention. As in the case of FIG. 5, the current conduction rod 8, the lead wire 16 and the driving device are omitted. In FIGS. 2 through 5, the hooking jigs rotate about the axis orthogonal to the plane in the direction in which the driven rod 4 moves. In contrast with this arrangement, the hooking jigs employed in the embodiment of FIG. 6 rotate about the axis parallel with the direction in which the driven rod 4 moves.

For the purpose of causing the hooking jigs to behave in this way, the rack 5 provided on the driven rod 4 driven by the driving device engages with a pinion 38 axially secured to the current conduction bar 1; the lateral movement of the rack 5 is replaced by the rotation of the pinion 38; a bevel gear 40 integrally provided with a pinion 39 meshing with the pinion 38 is rotated; a bevel gear 42 which is axially secured to a fitting 41 uprightly fitted to the current conduction bar 1 engages with the bevel gear 40 to propagate the rotation of the bevel gear 40 to the other bevel gear 42; a shaft 43 is rotated by moving the connecting rod 15 up and down which is fixed to one end of the bevel gear 42, thereby rotating the hooking jigs fixed to the shaft 43.

As is obvious from the description given above, the plating hooking apparatus according to the present invention provides the following effects. The plating hooking jigs incorporated into the converyer which moves between the aligned plating tanks can automatically be rotated with respect to the vertical plane in and above the plating tank, whereby the plating is uniformly effected. Especially when the plating hooking jigs are applied to the objects to be plated which assume intricate configurations, non-plating caused by the air pocket can be avoided, and the undesirable accumulation of the liquid between the plated objects can be eliminated, thereby minimizing the amount of the liquid taken out of the plating tank. In addition, the quality is improved, and excellent economical effects are yielded.

As many apparently widely different embodiments of this invention may be made without departing from the spirit and scope thereof, it is to be understood that the invention is not limited to the specific embodiments thereof except as defined in the appended claims.

What is claimed is:

1. A plating hooking apparatus comprising:

a plating tank;

a current conduction bar transferred by a conveyer to extend over said plating tank;

hung-down rods suspended from said current conduction bar;

hooking jigs rotatably axially secured at the center thereof to lower ends of said hung-down rods;

a driven rod disposed in parallel with said current conduction bar, said driven rod engaging with a driving unit to move in the lateral direction, and drive transmission means for rotating said hooking jigs by propagating the lateral movement of said driven rod to said hooking jigs.

2. A plating hooking apparatus as set forth in claim 1, wherein said driving unit is composed of a first driving device provided beside said plating tank and a second driving device suspended from a mount for said conveyer.

3. A plating hooking apparatus as set forth in claim 1, wherein said driving unit is composed of a driving device provided beside said plating tank and a guide groove inclined to a vertical line to engage with an end portion of said driven rod.

4. A plating hooking apparatus as set forth in claim 1, wherein said drive transmission means includes a rack provided on said driven rod, a pinion meshing with said rack, first converting means for converting a rotation of said pinion into a rectilinear motion, second converting means for converting said rectilinear motion into said rotary motion by interlocking with said first converting means and propagating means for propagating said rotary motion of said second converting means to said hooking jigs.

5. A plating hooking apparatus as set forth in claim 4, wherein said first converting means involves the use of a lever connected to a shaft of said pinion, a tip of said lever is provided with a connecting rod secured with a pin, the other end of said connecting rod is secured with a pin to the tip of another lever provided at the center of said hooking jigs, and said hooking jigs are thereby rotated in a vertical plane.

6. A plating hooking apparatus as set forth in claim 4, wherein said first converting means involves the use of a lever which operationally engages with said pinion and a rotary shaft thereof is linked to a bevel gear disposed in parallel with the direction in which said driven rod moves, a connecting rod is secured with a pin to a tip of said lever, the other end of said connecting rod is secured with a pin to a tip of another lever provided at the center of said hooking jigs, and said hooking jigs are thereby rotated in a plane orthogonal to the vertical plane thereof.

* * * * *